United States Patent [19]

Nobuyuki

[11] 3,995,970

[45] Dec. 7, 1976

[54] AXIAL-FLOW FAN

[75] Inventor: Yamaguchi Nobuyuki, Kobe, Japan

[73] Assignee: Mitsubishi Jukogyo Kabushiki Kaisha, Tokyo, Japan

[22] Filed: Sept. 3, 1975

[21] Appl. No.: 609,913

[30] Foreign Application Priority Data

Sept. 10, 1974 Japan ..... 49-108917[U]

[52] U.S. Cl. ..... 415/119; 415/181; 415/208; 415/210

[51] Int. Cl.[2] ..... F04D 29/66

[58] Field of Search ..... 415/119, 208, 181, 216, 415/210

[56] References Cited

UNITED STATES PATENTS

| | | | |
|---|---|---|---|
| 2,029,813 | 2/1936 | DeMey | 415/119 |
| 2,524,869 | 10/1950 | Adamtchik | 415/208 |
| 2,828,682 | 4/1958 | Marker | 415/208 |
| 2,962,260 | 11/1960 | Foley | 415/119 |
| 3,178,099 | 4/1965 | Child | 415/119 |
| 3,883,264 | 5/1975 | Rao | 415/208 |

FOREIGN PATENTS OR APPLICATIONS

| | | | |
|---|---|---|---|
| 226,203 | 7/1925 | United Kingdom | 415/119 |
| 409,322 | 4/1934 | United Kingdom | 415/119 |
| 441,269 | 1/1936 | United Kingdom | 415/119 |
| 631,231 | 10/1949 | United Kingdom | 415/119 |

*Primary Examiner*—Henry F. Raduazo

[57] ABSTRACT

An axial-flow fan characterized in that supporter blades provided at the upper stream of actuator blades are inclined at the upper stream side of air current from the center toward the tip and, at the same time inclined at a certain angle in the peripheral direction to a plane including the shaft axis.

1 Claim, 10 Drawing Figures

AXIAL-FLOW FAN

The present invention relates to axial-flow fans.

As shown in FIG. 1, in general, an axial-flow fan has actuator blades 1' and stator blades 2' as the essential, aerobdynamic elements thereof. In some cases, however, supporter blades 3' are provided at the upper stream of the actuator blades, as shown in FIG. 2, depending upon a driving system. These supporter blades 3' produce turbulence in an air current coming into the actuator blades 1' and, as a result, the noise level of said fan is increased. FIGS. 1 and 2 are illustrative of prior art axial flow fans.

It is an object of the present invention to reduce the noise level of an axial-flow fan of such a type having supporter blades at the up stream side of actuator blades, without reducing fan performance. In order to achieve this object, according to the present invention, (i) the supporter blades are provided with two distinct inclinations, the first being an inclination toward the upstream side of gas flow from the inner diameter side (the root end) toward the outer diameter side (the tip end) and (ii) the second being an inclination of predetermined angle to provide spacing in circumferential direction relative to a radius line in a plane including the axis of the shaft which rotates the actuator blades. The present invention finds utility in axial-flow fans, blowers and likes.

The apparatus of the invention will be described in more detail below with reference to the accompanying drawings, in which.

Figure 3:
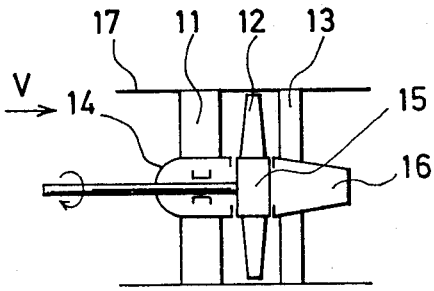
FIG. 3 is a rough side view, in longitudinal section, of a typical axial-flow fan in which supporter blades are provided at the upper stream side of actuator blades.
Figure 4:
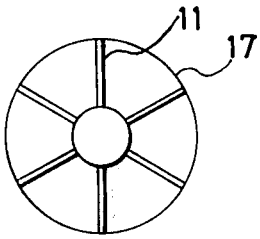
FIG. 4 is a front view in the direction of the arrow V (in FIG. 3) of the fan shown in FIG. 3.
Figure 5:
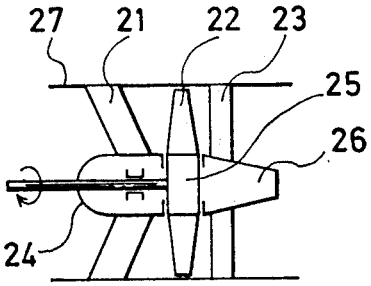
FIG. 5 is a rough side view, in longitudinal section, of an axial-flow fan of one embodiment according to the present invention.
Figure 6:
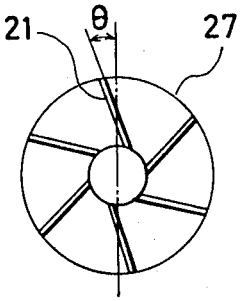
FIG. 6 is a front view of the axial-flow fan in FIG. 5.
Figure 8:
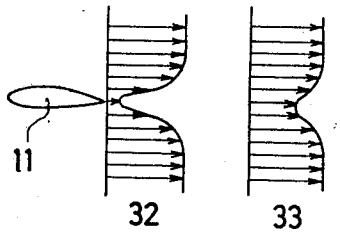
Figure 9:
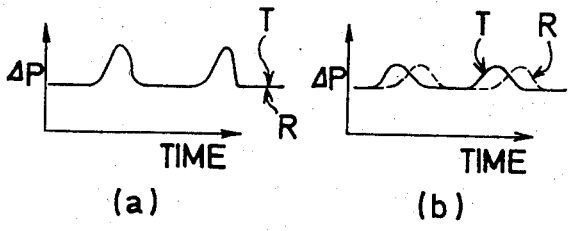

FIG. 8 is an illustrative view showing a distribution (wake) of air current in case of the ordinary supporter blades in FIG. 3 and 4 and the distribution of air current when supporter blades and actuator blades are related to each other in accordance with the invention; and FIGS. 9 (*a*) and (*b*) show wake profiles of the ordinary supporter blades shown in FIGS. 3 and 4 and of the supporter blades according to the present invention shown in FIGS. 5 and 6, respectively.

The present invention will be described with reference to FIG. 3 – FIG. 9(*b*).

Figure 1:
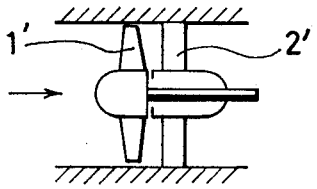
FIG. 1 and FIG. 2 are rough side views, in longitudinal section, of a conventional axial-flow fan having actuator blades and stator blades and a conventional axial-flow fan in which supporter blades are provided at the up stream side of the actuator and stator blades respectively.
Figure 2:
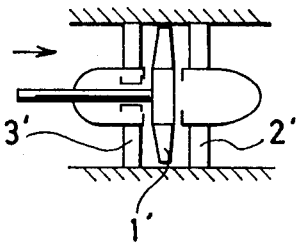

In FIG. 3 and FIG. 4, an ordinary axial-flow fan structure is shown which is of such a type as shown in FIG. 2, wherein the reference numeral 11 represents supporter blades, 12: actuator blades, 13: stator blades, 14: a front inner drum, 15: a blade wheel boss, 16: a rear inner drum and 17: a fan casing.

Figure 7:
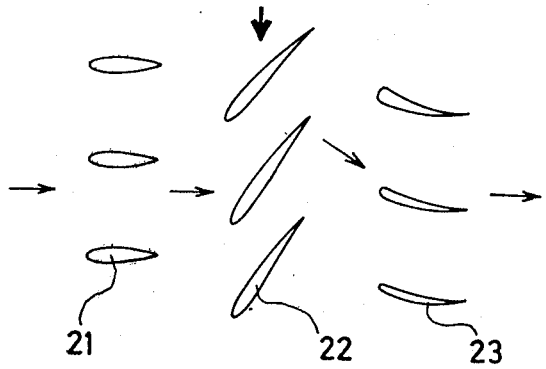
FIG. 7 is a development view showing the supporter blades, actuator blades and stator blades of FIGS. 5 and 6.

FIG. 5 and FIG. 6 show an axial-flow fan structure according to the present invention, wherein the reference numeral 21 represents forwardly inclined supporter blades, 22: actuator blades, 23: stator blades, 24: a front inner drum, 25: a blade wheel boss, 26: a rear inner drum and 27: a fan casing. FIG. 7 is a development view showing the blade lattice of each said supporter blades 21, actuator blades 22 and stator blades 23.

Differences between the axial-flow fan of the present invention and the ordinary axial-flow fan are based upon a manner of setting the supporter blades shown at 11 and 21, as can be seen by comparing FIGS. 3 and 4 with FIGS. 5 and 6.

In the typical axial-flow fan, the chord of the supporter blades 11 is in a plane including the central axis of rotation, and moreover its plane contour (not cross sectional) constitutes an almost rectangular form almost normal to the central axis of rotation. Such contour is advantageous for supporting the blade wheel and shaft line.

In the axial-flow fan according to the present invention, contrary to the showing in FIGS. 3 and 4, the supporter blades 21 are inclined in two directions, a first at a certain angle $\theta$ to a plane including the central axis of rotation as shown in FIG. 6, and a second in a direction as shown in FIG. 5 wherein the supporter blades are increasingly spaced from the actuator blades from the blade root side toward the tip side of the actuator and supporter blades.

In an axial-flow fan of the type where supporter blades are provided up stream of the actuator blades as shown in FIG. 3 (or FIG. 2), a supported blade caused, air current distribution, for example, a low-velocity area low in energy called "wake", which is shown at 32, is formed as shown in FIG. 8. When the down stream actuator blades 12 are rotated, they cross these wakes, resulting in pressure variations on the surface of said actuator blades 12, which produces noise. The larger a distance between the supporter blades 11 and the actuator blade 12, the lower the noise becomes because the more the actuator blades 12 are separated from the supporter blades 11 toward the down stream, the flatter becomes the unevenness of velocity in the wakes as shown at 33. However, the relative inlet velocity to the actuator blades 12 is larger at a position nearer to the outer diameter side.

Since at a position nearer to the relative inlet velocity multiplied by the extent of the disproportion of velocity has an influence upon the noise level, it is advantageous to reduce the disproportion of velocity at a position nearer to the outer diameter side. By inclining the supporter blades at a certain angle $\theta$ to a plane including the central axis of rotation as shown at 21 in FIG. 6, therefore, a distance between the supporter blades 21 and the actuator blades 22 is made larger where outer diameter side at that the relative inlet velocity of the actuator blades is large. Thus, the unevenness of velocity in the wakes becomes small and, as a result, noise can be effectively lowered.

If each supporter blade were disposed in the radius line as in the case of the typical supporter blades 11 shown in FIGS. 3 and 4 and the wakes were to overlap one another substantially in the same radius line as shown in FIG. 9(*a*), the actuator blades 12 from their tip to their root would come into the wakes simultaneously and go out therefrom simultaneously, whereby the amplitude of a pressure variation on the surface of the actuator blades is increased and, as a result, the noise level is made high.

In case the supporter blades 21 according to the present invention are inclined to the radius line (at an angle $\theta$) as described in the above, on the other hand, their wakes overlap one another at the almost same angle $\theta$. Thus, the actuator blades 22 come into the wakes and go out therefrom with a time lag from the tip toward the root as shown in FIG. 9(*b*). The pressure variation on the surface of said actuator blades is relieved by account of a lag of its phase in the radial direction and, therefore, its amplitude is reduced with attributing to the lowering of the noise level. In FIGS. 9(*a*) and (*b*), in addition, the designation $\Delta P$ is a pressure variation on the actuator blade surface, T: an actuator blade tip and R: an actuator blade root, and these curves show their wake profiles respectively.

As described with reference to the above embodiment, the present invention is intended to provide an axial-flow fan characterized in that supporter blades provided at the upper stream of actuator blades are inclined at the upper stream side of air current from the center (root) toward the tip (outer diameter side) and, at the same time, inclined at a certain angle in the peripheral direction to a plane including the shaft axis (the radius line).

According to the present invention, namely the supporter blade wakes on the outer diameter portion most attributing to production of noise are enervated by inclining the supporter blades to the upper stream side of air current from the center (root) toward the outer diameter side and, at the same time, a time lag in the radial direction of the interference of the wakes and the actuator blades is caused by further inclining the supporter blades to a plane including the shaft axis (the radius line), whereby the pressure variation quantity can be relieved. In other words, according to the present invention, the lowering of the fan noise can be achieved without modifying the fan structure and size by a large margin.

What is claimed is:

1. An axial flow fan comprising within a casing stator blades, supporter blades and actuator blades, the latter being intermediate said stator and supporter blades and being mounted therebetween for rotation by a shaft, said supporter blades being upstream, relative to the direction of gas flow, of said stator and actuator blades, and for reducing noise created by wakes resulting from gas passage past said supporter blades to said actuator blades, the supporter blades have leading and trailing edges inclined from their roots to their tip ends in an axial upstream direction relative to the actuator blades to gradually increase the distance between the trailing edge of the supporter blades and the leading edge of the actuator blades, said supporter blades also being inclined at a predetermined angle in circumferential direction relative to a plane including the axis of the shaft.

* * * * *

UNITED STATES PATENT AND TRADEMARK OFFICE

CERTIFICATE OF CORRECTION

PATENT NO. : 3,995,970

DATED : December 7, 1976

INVENTOR(S) : Nobuyuki YAMAGUCHI

It is certified that error appears in the above-identified patent and that said Letters Patent are hereby corrected as shown below:

On the sheet containing the ABSTRACT amend item [75] i.e. the name of the inventor, to read --NOBUYUKI YAMAGUCHI--.

Signed and Sealed this

Nineteenth Day of April 1977

[SEAL]

*Attest:*

RUTH C. MASON
*Attesting Officer*

C. MARSHALL DANN
*Commissioner of Patents and Trademarks*